US012565354B2

(12) United States Patent
Comerford

(10) Patent No.: US 12,565,354 B2
(45) Date of Patent: Mar. 3, 2026

(54) SHIPPING CONTAINER SYSTEMS

(71) Applicant: Brent Comerford, Aliso Viejo, CA (US)

(72) Inventor: Brent Comerford, Aliso Viejo, CA (US)

( * ) Notice: Subject to any disclaimer, the term of this patent is extended or adjusted under 35 U.S.C. 154(b) by 21 days.

(21) Appl. No.: 18/614,161

(22) Filed: Mar. 22, 2024

(65) Prior Publication Data

US 2024/0317454 A1 Sep. 26, 2024

Related U.S. Application Data

(60) Provisional application No. 63/453,867, filed on Mar. 22, 2023.

(51) Int. Cl.
*B65D 81/07* (2006.01)
*B65D 5/42* (2006.01)
*B65D 5/50* (2006.01)

(52) U.S. Cl.
CPC ..... *B65D 5/5045* (2013.01); *B65D 5/4204* (2013.01)

(58) Field of Classification Search
CPC .... B65D 5/5028; B65D 81/07; B65D 81/075; B65D 81/05; B65D 81/022; B65D 5/5021; B65D 5/2057; B65D 5/5035; B65B 5/04; B65B 55/20
USPC ..... 206/583, 591, 521, 594, 523, 279; 220/6
See application file for complete search history.

(56) References Cited

U.S. PATENT DOCUMENTS 4,013,170 A * 3/1977 Hutterer ..... B65D 81/07 206/583
4,606,460 A * 8/1986 Luray ..... B65D 81/07 206/583
2011/0240515 A1* 10/2011 Ridgeway ..... B65D 5/5028 53/472
2013/0233752 A1* 9/2013 Hammerschmidt . B65D 5/5028 53/467

* cited by examiner

*Primary Examiner* — King M Chu
(74) *Attorney, Agent, or Firm* — Camuti Law Group APC; Nathan B. Camuti

(57) ABSTRACT

A suspension shipping system which may be foldable and may have a product retention compartment. The suspension shipping system may provide for complete air cushion gap around the product retention compartment by way of an extended first lateral suspension element, second lateral suspension element, front suspension element, first lower cushion support element, and second lower cushion support element. Said configuration allows for the suspension shipping system to be placed inside of an outer container for shipping allowing for the contents of the product retention compartment to remain unharmed during shipping.

17 Claims, 13 Drawing Sheets

SHIPPING CONTAINER SYSTEMS

BACKGROUND

Shipping products to consumers has become a vital part of our everyday lives. Shipping containers are typically designed to maximize efficiency in packing shipping vehicles. Frequently, a shipping container contains items that fill only a small portion of the volume of the container, requiring the space to be filled with other material, such as air-filled plastic pouches or shredded paper. Alternative solutions include affixing products to a piece of cardboard using plastic film of sorts and adding some pieces to cause the plastic wrapped board and product to remain positioned in the cavity of the box. Existing solutions are expensive and use excess materials, including excessive waste materials. More economical and ecologically friendly systems are needed.

SUMMARY

Certain deficiencies of the prior art are overcome by the provision of embodiments of an apparatus, kit and system in accordance with the present disclosure. The present disclosure is directed to shipping container systems, substantially as shown in and/or described in connection with a suspension shipping system which may have a product retention compartment from which may extend a first lateral suspension element, a second lateral suspension element, a front suspension element, a first lower cushion support element, and a second lower cushion support element. The extension of the first lateral suspension element, the second lateral suspension element, the front suspension element, the first lower cushion support element and the second lower cushion support element may form an air cushion gap. The air cushion gap may completely envelop the product retention compartment.

In some other embodiments, a foldable suspension shipping system may be described as having a product retention compartment, a first lateral suspension element, and a second lateral suspension element which may extend from the product retention compartment laterally. The product retention compartment may further have a front suspension element extending from the product retention compartment frontally. The product retention compartment may further have a first lower cushion support element and a second lower cushion support element may also extend from the product retention compartment lowerly. The product retention compartment may be configured for placement in an interior portion of an outer container. The product retention compartment may have an air cushion gap which extends three hundred and sixty degrees (360) around the product retention compartment when the product retention compartment is placed into an outer container.

In some other embodiments, a continuously connected suspension shipping system for placement inside of an outer container may be described as having a first product retention member and a second product retention member being folded along a first fold line to form a product retention compartment. The continuously connected suspension shipping system may further have a first lateral suspension element being folded along a seventh fold line and an eighth fold line. The continuously connected suspension shipping system may further have a second lateral suspension element being folded along a fifth fold line and a sixth fold line, and a front suspension element being folded along a second fold line. The continuously connected suspension shipping system may further have a third fold line and a fourth fold line. The continuously connected suspension shipping system may further have a first lower cushion support element being folded along a second lower fold line and a second lower cushion support element being folded along a first lower fold line.

BRIEF DESCRIPTION OF THE DRAWINGS

The foregoing and other features of the present disclosure will become more fully apparent from the following description, taken in conjunction with the accompanying drawings. Understanding that these drawings depict only several embodiments in accordance with the disclosure and are not to be considered limiting of its scope, the disclosure will be described with additional specificity and detail through the use of accompanying drawings. Accordingly, further advantages of the present disclosure may become apparent to those skilled in the art with the benefit of the following detailed description of the preferred embodiments and upon reference to the accompanying drawings in which.

DESCRIPTION OF THE PREFERRED EMBODIMENTS

Figure 1:
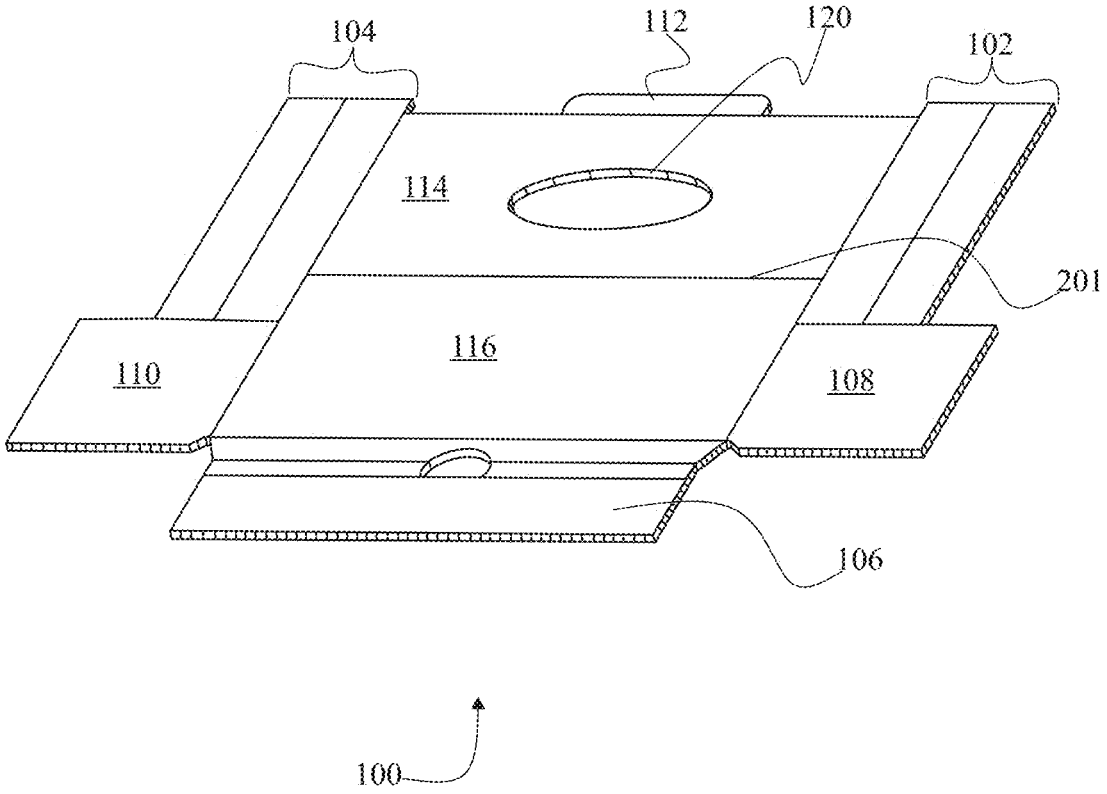
FIG. 1 is a perspective view of an apparatus (devices) in accordance with one non-limiting embodiment of an unfolded suspension shipping system.

Embodiments of systems, components, and methods of assembly and manufacture will now be described with reference to the accompanying figures. Although several embodiments, examples, and illustrations are disclosed below, it will be understood by those of ordinary skill in the art that the embodiments described herein extend beyond the specifically disclosed configurations, examples, and illustrations, and can include other users of the disclosure and obvious modifications and equivalents thereof. The terminology used in the descriptions presented herein is not intended to be interpreted in any limited or restrictive manner simply because it is being used in conjunction with a detailed description of certain specific embodiments of the disclosure. In addition, embodiments of the disclosure can comprise several novel features and no single feature is solely responsible for its desirable attributes or is essential to practicing any one of the several embodiments herein described.

Certain terminology may be used in the following description for the purpose of reference only, and thus are not intended to be limiting. For example, terms such as "above" and "below" refer to directions in the drawings to which reference is made. Terms such as "front," "back," "left," "right," "rear," "top," "bottom" and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specially mentioned above, derivatives thereof, and words of similar import. The drawings and illustrations in the present application are generally not at scale and are not intended to correspond to actual relative dimensions.

Referring to the drawings, like reference numerals designate identical or corresponding features throughout the several views. Described herein are certain non-limiting embodiments of a suspension shipping system 100 for use in the application and support of shipping features, instillation into larger containers, and similar functions therein.

Figure 2:
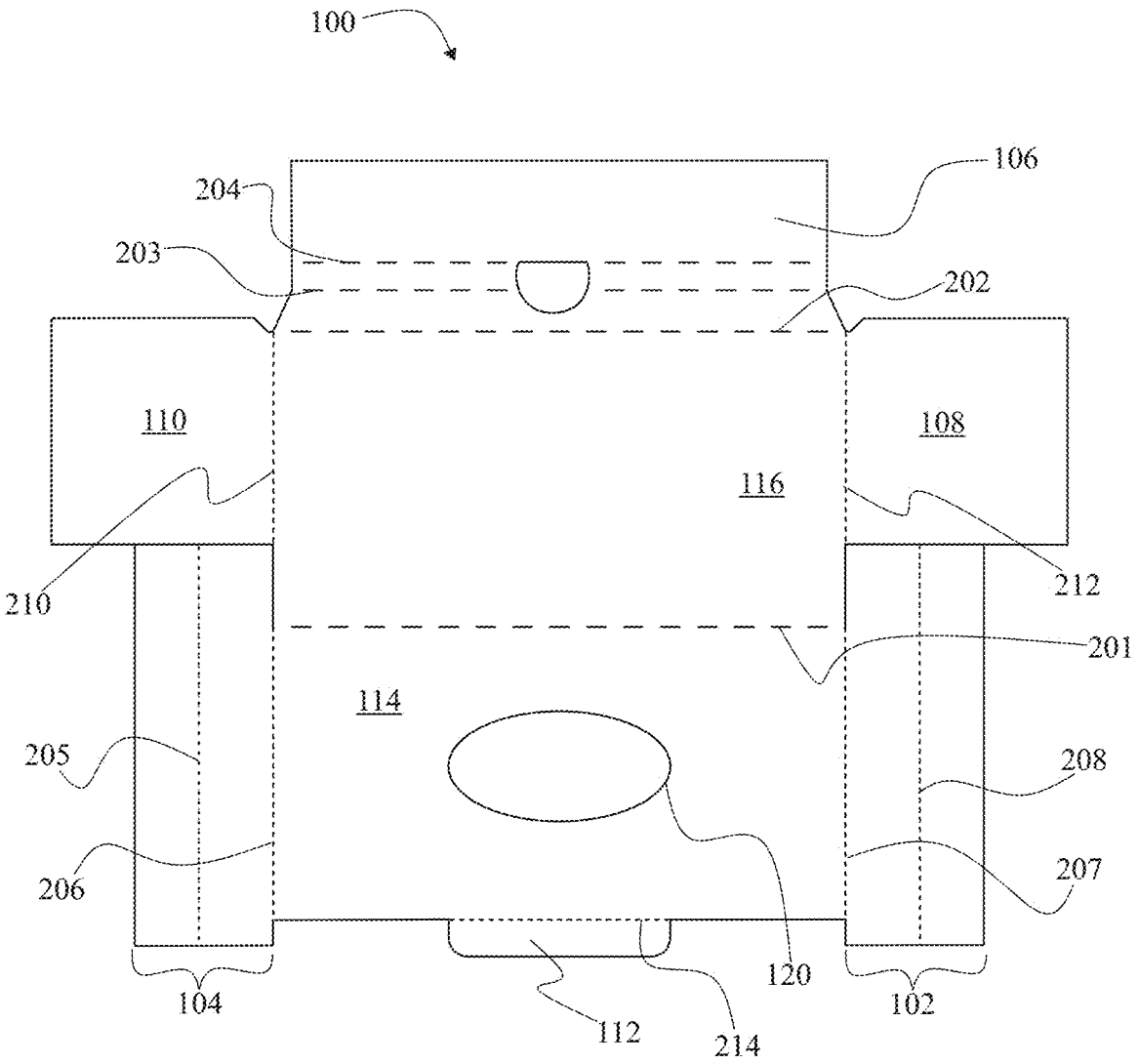
FIG. 2 is a schematic above view of one non-limiting embodiment of an unfolded suspension shipping system, wherein a one or more than one fold line may be indicated.
Figure 4:
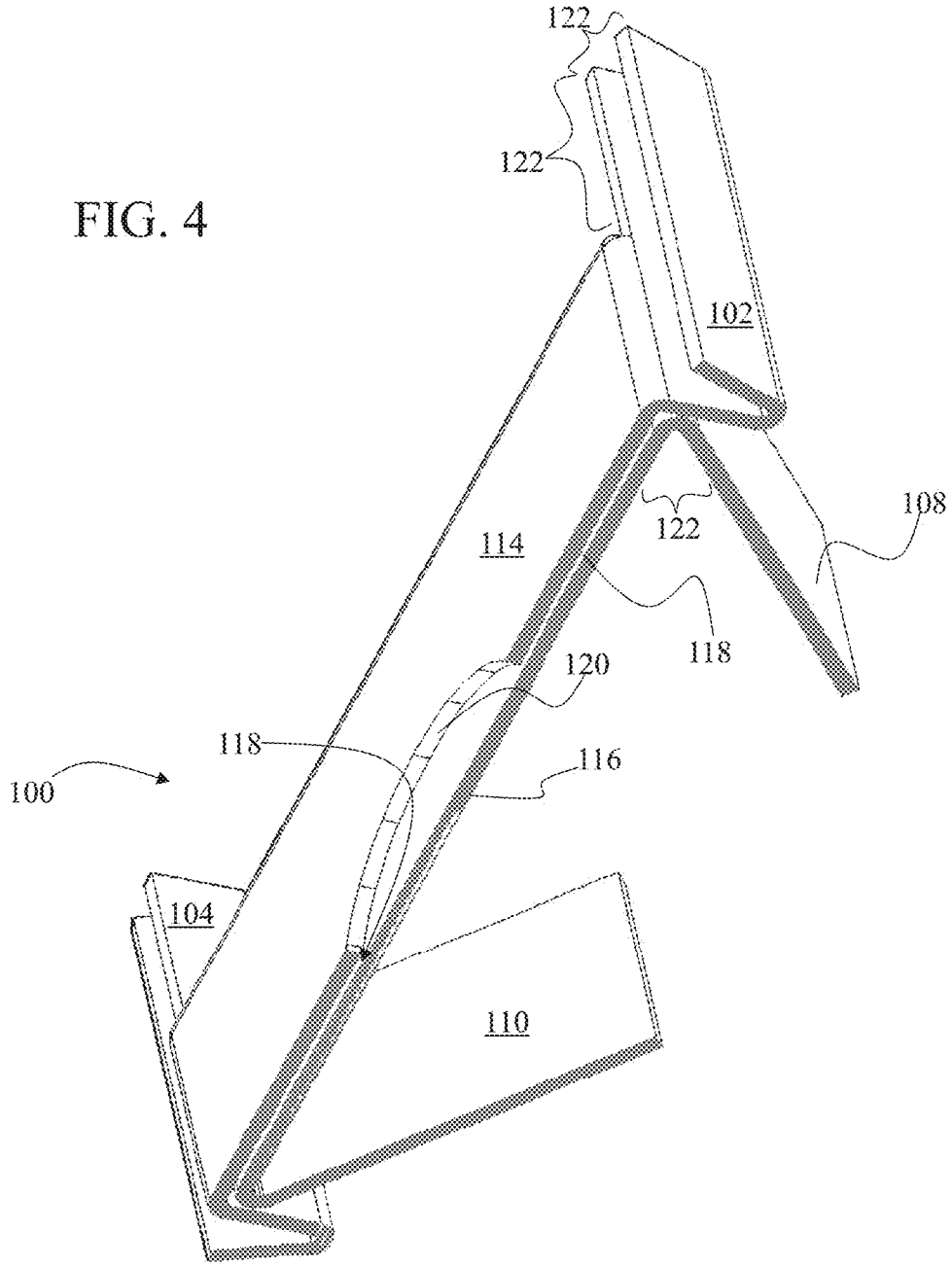
FIG. 4 is cross sectional view of one non-limiting embodiment of the folded suspension shipping system of FIG. 3.

Suspension shipping system 100, as illustrated in FIGS. 1 and 2, is seen as pre-folded. FIG. 2 shows an above schematic view, while FIG. 1 shows a perspective of the flat pre-folded system. Shown is a first lateral suspension element 102, a second lateral suspension element 104, a front suspension element 106, and a lower cushion support element 108. Additionally seen is a securing tab 112 in association with the suspension shipping system 100. The securing tab 112 may extend upwards from the front edge of the top of a first product retention member 114. The first product retention member 114 may be attached to a second product retention member 116. The formation of a product retention compartment 118 (by way of example, as seen in FIG. 4) may be formed by folding the suspension shipping system 100 along a first fold line 201. The first fold line 201 is illustrated as a dotted line in FIG. 2. The first product retention member 114 may further include a product viewing portal 120 for viewing of product inside of a folded suspension shipping system 100.

Additionally seen in FIG. 2 are a series of fold lines. Noted is the first fold line 201, additionally seen is a second fold line 202, a third fold line 20, a fourth fold line 204, a fifth fold line 205, a sixth fold line 206, a seventh fold line 207, an eighth fold line 208, and first lower fold line 210, a second lower fold line 212, and a securing tab fold line 214 (all fold lines referred to in this paragraph are collectively herein referred to as the "various fold lines").

Figure 3:
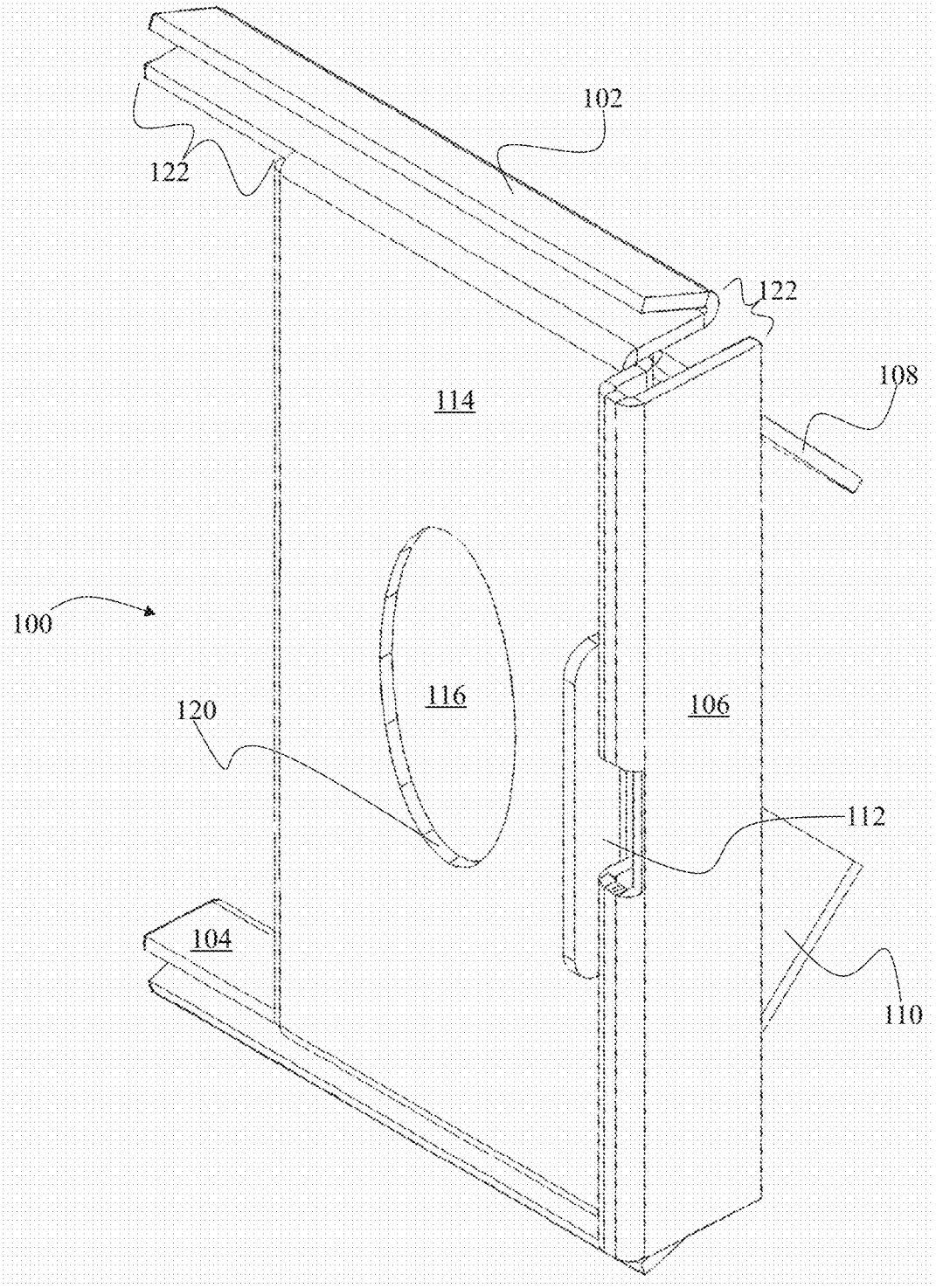
FIG. 3 is perspective view of one non-limiting embodiment of a folded suspension shipping system.

Suspension shipping system 100, as illustrated in FIG. 3, is seen as folded. FIG. 3 includes all of the aforementioned elements, and in addition, and by way of example only, as can be seen in some embodiments, the first lateral suspension element 102, the second lateral suspension element 104, or the front suspension element 106, may be contemplated as extending beyond the front and rear of the product retention compartment 118 (as seen in FIG. 4). By providing a first lateral suspension element 102, second lateral suspension element 104, and/or front suspension element 106 as extending beyond physical dimensions of the product retention compartment 118, the suspension shipping system 100 may therein incorporate an air cushion gap 122 around the perimeter of the product retention compartment 118 when installed in an outer container 300 (by way of example only, as additionally seen in FIG. 13). Additionally, the extension of the first lateral suspension element 102 and the second lateral suspension element 104 may be above the product retention compartment 118 and may create and maintain an air cushion gap 122 above the product retention compartment 118 while the suspension shipping system 100 is placed into an outer container 300.

The illustrated FIG. 3 as a folded configuration. The product retention compartment 118 may be achieved by using the first fold line 201. The folded configuration of the front suspension element 106 may be achieved by using the second fold line 202, the third fold line 203, and the fourth fold line 204. The folded configuration of the first lateral suspension element 102 may be achieved by way of using the fifth fold line 205 and sixth fold line 206. The folded configuration of the second lateral suspension element 104 may be achieved by way of using the seventh fold line 207 and eighth fold line 208. The first lower cushion support element 108 may be deployed by using the first lower fold line 210. The second lower cushion support element 110 may be deployed by using the second lower fold line 212. Securing tab 112 may be deployed using the securing tab fold line 214.

The folded configuration of the suspension shipping system 100 may confer some benefits on the user. Through the various fold lines, and the folded configuration of the suspension shipping system 100, the folded configuration of the suspension shipping system 100 generally aids in the maintaining of the indicated air cushion gap 124 seen, by way of example only, in FIGS. 4 and 13.

Now referring to FIG. 4, seen is a cross section of the suspension shipping system 100 of FIG. 3. Including prior reference numbers, further illustrated in this cross section is the product retention compartment 118 with the product viewing portal 120, according to an embodiment of the present disclosure. The product viewing portal 120 may provide an opening by which product viewing occurs into the space herein referred to as the product retention compartment 118. Said product retention compartment 118 may be formed when a fold occurs along first fold line 201 which may create a compartment for shipping.

Additionally well viewed in FIG. 4 are the first lateral suspension element 102, the second lateral suspension element 104, the front suspension element 106, the first lower cushion support element 108, the second lower cushion support element 110 may fold along respective various fold lines. Seen here is the air cushion gap 122 formation in multiple locations and due to various structural details of the suspension shipping system 100. For example, an air cushion gap 122 can be seen being formed along three axis of movement, specifically along an X, Y, and Z axis of potential motion. This helps to form a complete air cushion gap 122 between the product retention compartment 118 and the outer container 300 such that 360 degrees of the suspension shipping system 100 may be cushioned by an air cushion gap 122. This air cushion gap 122 may be formed, as mentioned, by extending the first lateral suspension element 102 and the second lateral suspension element 104 outward as seen, or as seen the various fold lines can additionally form air cushion gap 122.

Still referring the FIG. 4, the first lateral suspension element 102, the second lateral suspension element 104, and/or the front suspension element 106 may extend above the product retention compartment 118 when the suspension shipping system 100 is installed into an outer container 300 such that the top of the outer container 300 may apply a downward force to the suspension shipping system 100 while the first lower cushion support element 108 and the second lower cushion support element 110 may provide an upward force to the suspension shipping system 100. In some embodiments the downward force may apply a closure force to the product retention compartment 118. The extension of the first lateral suspension element 102 and the second lateral suspension element 104

Still referring to FIG. 4, the first lower cushion support element 108 and the second lower cushion support element 110 may further provide a closure force of the product retention compartment 118 as the suspension shipping system 100 is placed into an outer container 300. Said closure force would likely aid in maintaining a closed environment for the product retention compartment 118. Additionally, an air cushion gap 122 may further be maintained when the product retention compartment 118 is in a closed configuration due. Said air cushion gap 122 may be maintained between the second product retention member 116 and the two lower cushion support elements, the first lower cushion support element 108 and the second lower cushion support element 110, respectively.

Further illustrated in FIG. 4 is extension of the first lower cushion support element 108 and the second lower cushion support element 110 from the second product retention member 116 such that the first lower cushion support element 108 and the second lower cushion support element 110 form and maintain the respective air cushion gap 122 below the product retention compartment 118 when the suspension shipping system 100 is installed into an outer container 300 (by way of example only in FIG. 13). In some embodiments, the extension of the first lower cushion support element 108 and the second lower cushion support element 110 below the product retention compartment 118 may allow for some movement of the product retention compartment 118 in the height of the outer container 300, thus providing a spring-force suspension to maintain the air cushion gap 122 below the product retention compartment 118 when the suspension shipping system 100 is installed into an outer container 300. In some embodiments, the combination of the first lateral suspension element 102 and the second lateral suspension element 104 extending from the ends of the product retention compartment 118 and the first lower cushion support element 108 and the second lower cushion support element 110 being folded below the product retention compartment 118 support the product retention compartment 118 at height of the outer container 300 in which the suspension shipping system 100 may be installed therein creating a 360 degree air cushion gap 122 for the product retention compartment 118. (For example only, FIG. 13.)

Figure 5:
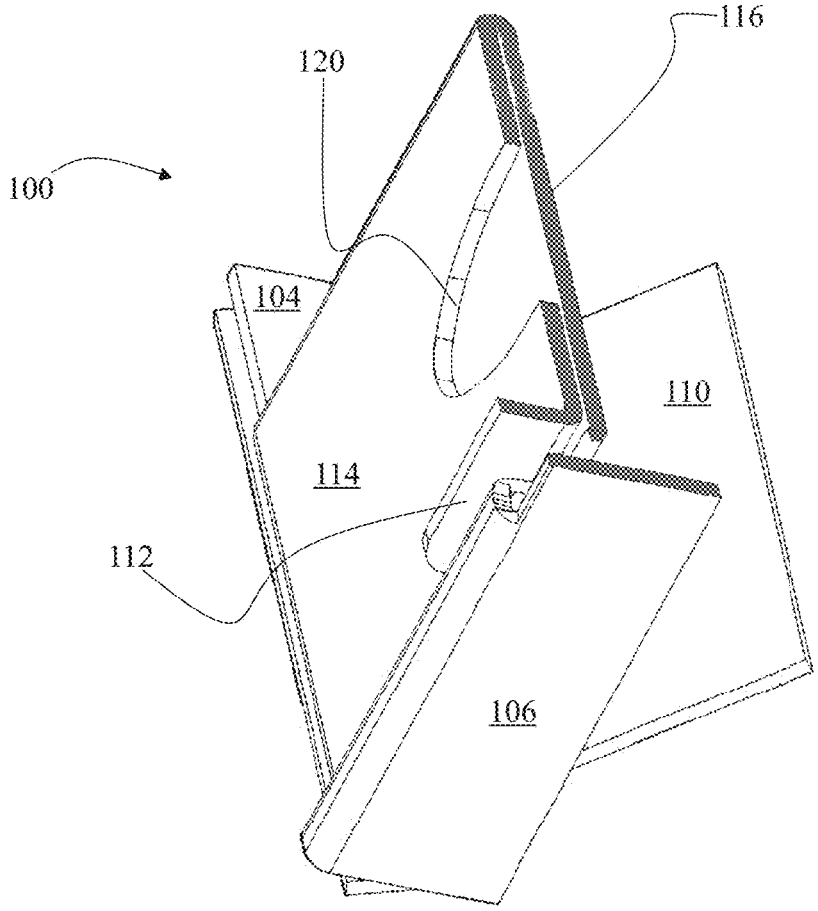
FIG. 5 is a cross sectional view of one non-limiting embodiment of the folded suspension shipping system of FIG. 3.

FIG. 5 shows another cross section of the suspension shipping system 100 from FIG. 1 according to one embodiment of the present disclosure. As seen in FIG. 3, the suspension shipping system 100 includes a product retention compartment 118 securing tab 112 extending upwards from the front edge of a top of the product retention compartment 118. The product retention compartment 118 securing tab 112 extending upwards from the front edge of a top of the product retention compartment 118 may engage with the top of an outer container when the suspension shipping system 100 is installed in the outer container 300. The top of the outer container 300 may apply downward force to the product retention compartment 118 securing tab 112 when the outer container is in a closed configuration. The downward force may act as a closure force pressing the first product retention member 114 to the second product retention member 116 when the suspension shipping system 100 is placed into an outer container 300 and the outer container 300 is in a closed configuration.

Seen in FIG. 5, the suspension shipping system 100 includes a front suspension element 106 extending from the front of the product retention compartment 118. The front suspension element 106 may extend from the second product retention member 116 and be folded in a configuration to create and maintain an air cushion gap 122 in front of the product retention compartment 118 when the suspension shipping system 100 is installed in an outer container 300. In some embodiments, the front suspension element 106 may be formed from a panel extending from the front of the second product retention member 116. In other embodiments, the front suspension element 106 may be formed from a panel extending from the front of the first product retention member 114. In some embodiments, the panel that forms the front suspension element 106 may be folded from a packing material that forms the outer container 300, thus creating a shipping container system including the outer container and the suspension shipping system 100. In some embodiments, the shipping container system may be folded from a single blank of packing material.

Figure 6:
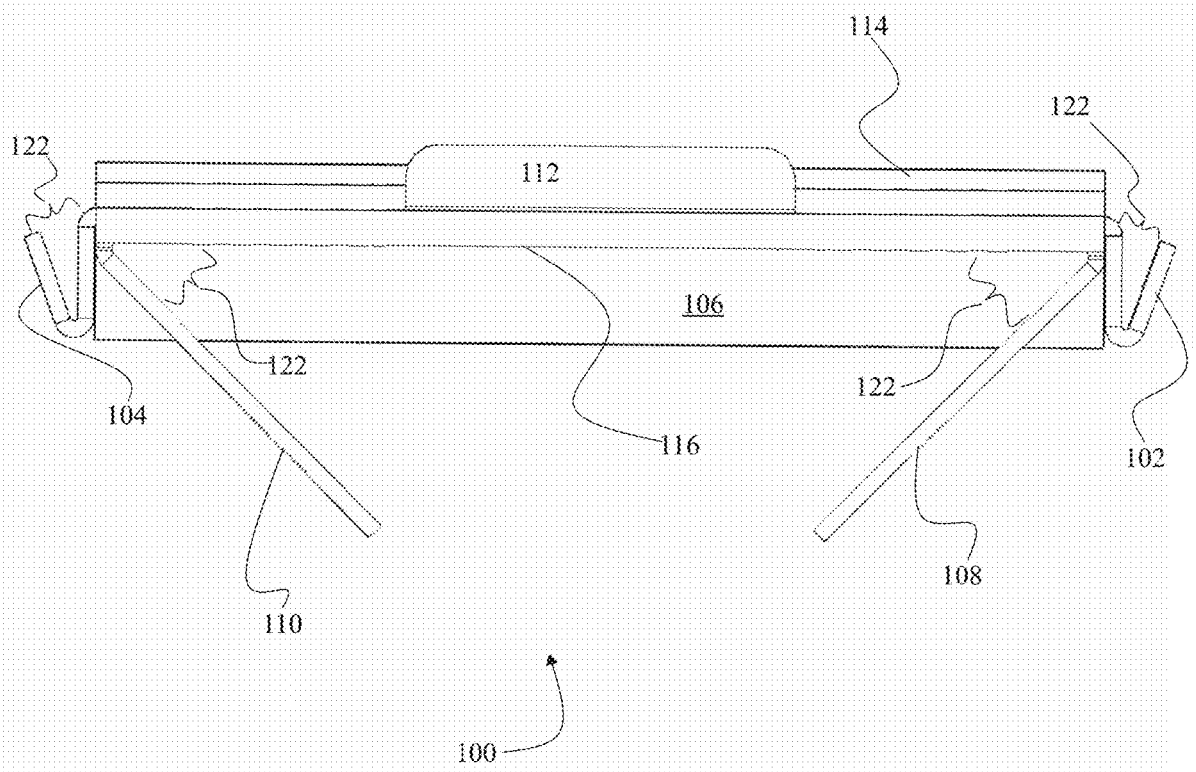
FIG. 6 is a rear view of one non-limiting embodiment of a folded suspension shipping system.

FIG. 6 shows a rear view of the suspension shipping system 100 of FIG. 1, according to one embodiment of the present disclosure. As seen in FIG. 6, the product retention compartment 118 is formed when the first fold line 201 (as seen in FIG. 2) deployed to bring the first product retention member 114 and second product retention member 116 together (as seen in FIG. 3).

Figure 7:
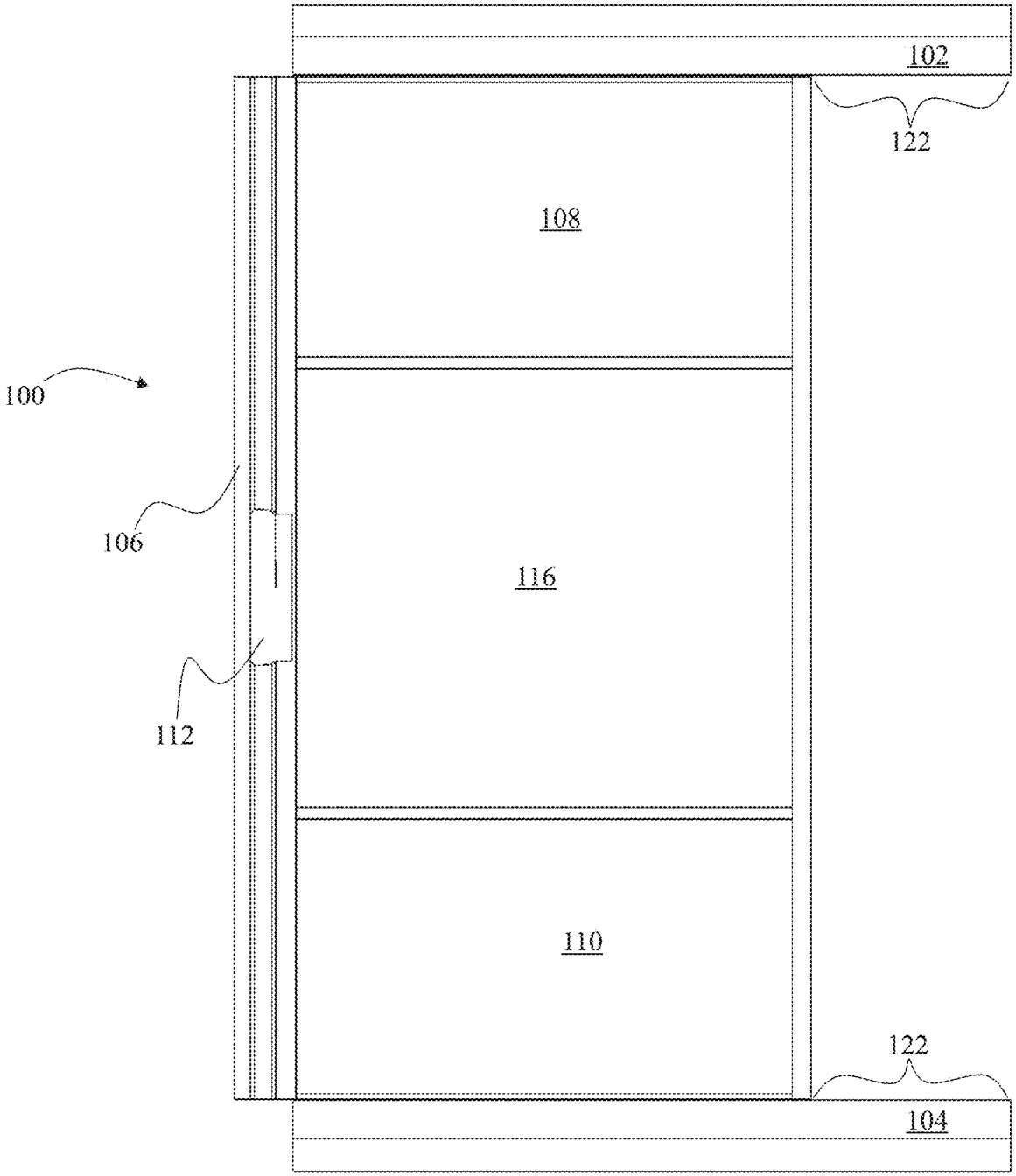
FIG. 7 is a bottom view of one non-limiting embodiment of a folded suspension shipping system.

FIG. 7 shows a bottom view of the suspension shipping system 100 of FIG. 1, according to one embodiment of the present disclosure. Well-illustrated in FIG. 7 are the use of extending the first lateral suspension element 102 beyond the product retention compartment 118 to form an air cushion gap 122 via the structure of the packing material.

Figure 8:
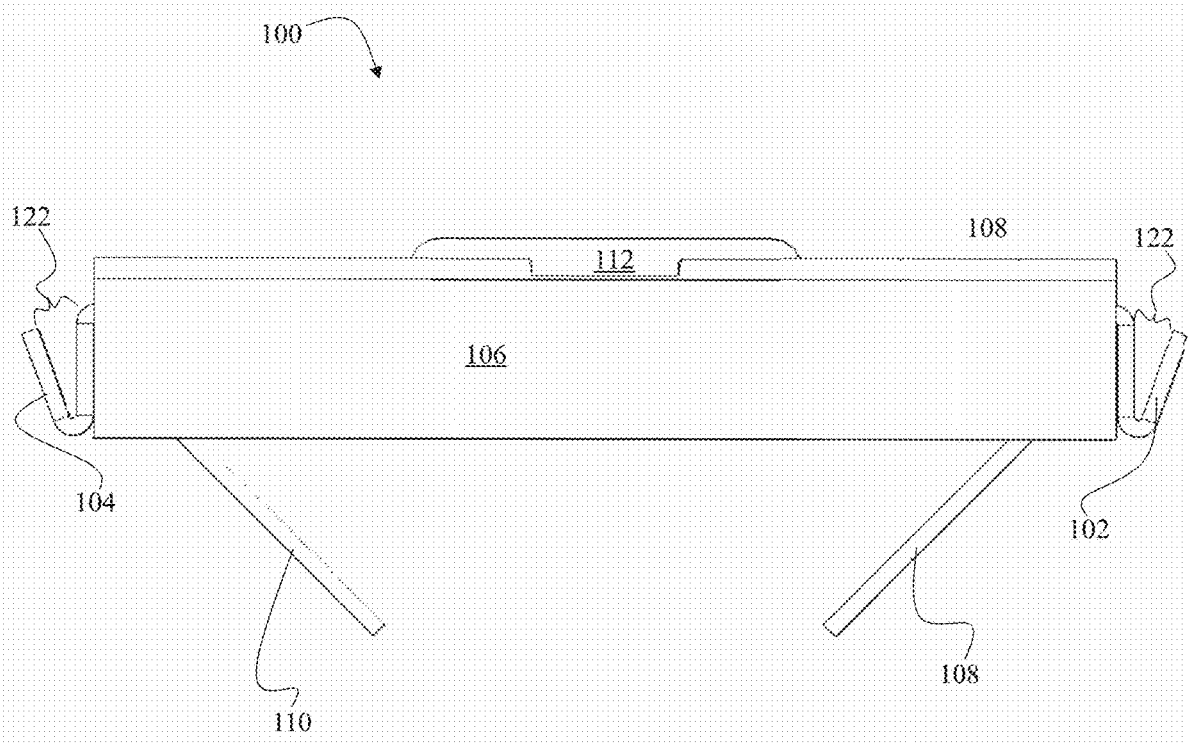
FIG. 8 is a front view of one non-limiting embodiment of a folded suspension shipping system.

FIG. 8 shows a front view of the suspension shipping system 100 of FIG. 1, according to one embodiment of the present disclosure. Illustrated in FIG. 8 is the first lower cushion support element 108 and the second lower cushion support element 110 may further provide a closure force of the product retention compartment 118 as the suspension shipping system 100 is placed into an outer container 300. It is more apparent here how said closure force could aid in maintaining a closed environment for the product retention compartment 118. Additionally, the air cushion gap 122 formed adjacent to the first lateral suspension element 102 and the second lateral suspension element 104 are well highlighted here.

Figure 9:
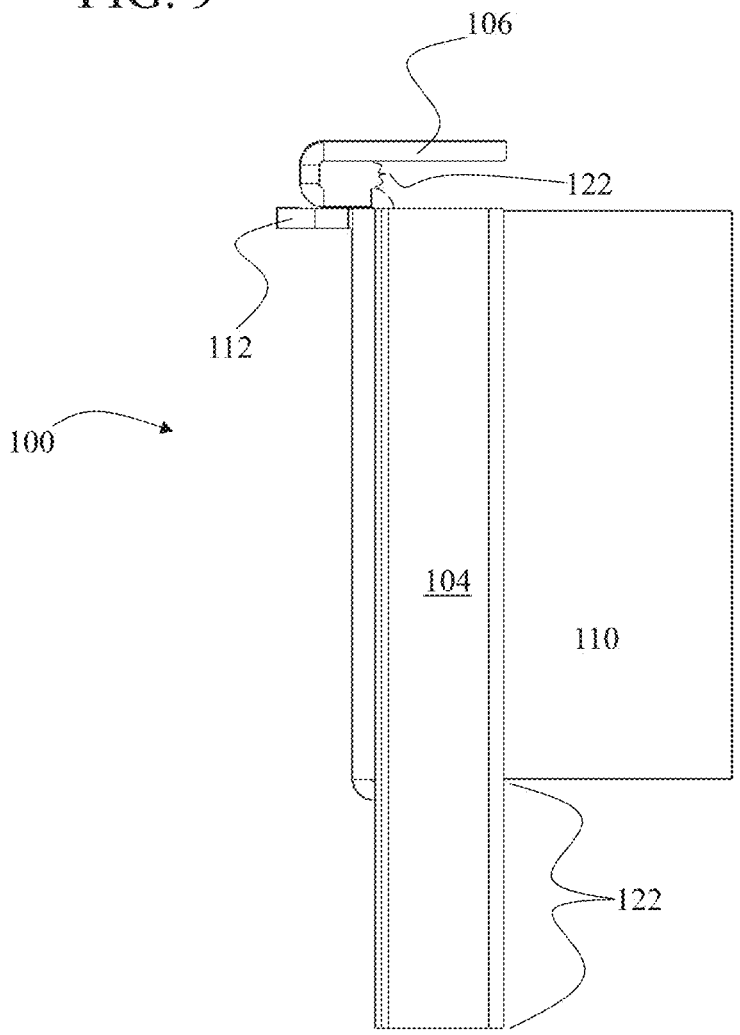
FIG. 9 is a right-side view of one non-limiting embodiment of a folded suspension shipping system.

FIG. 9 shows a right-side view of the suspension shipping system 100 of FIG. 1, according to one embodiment of the present disclosure. Well-illustrated in FIG. 9 are the use of extending the second lateral suspension element 104 beyond the product retention compartment 118 to form an air cushion gap 122 via the structure of the packing material.

Figure 10:
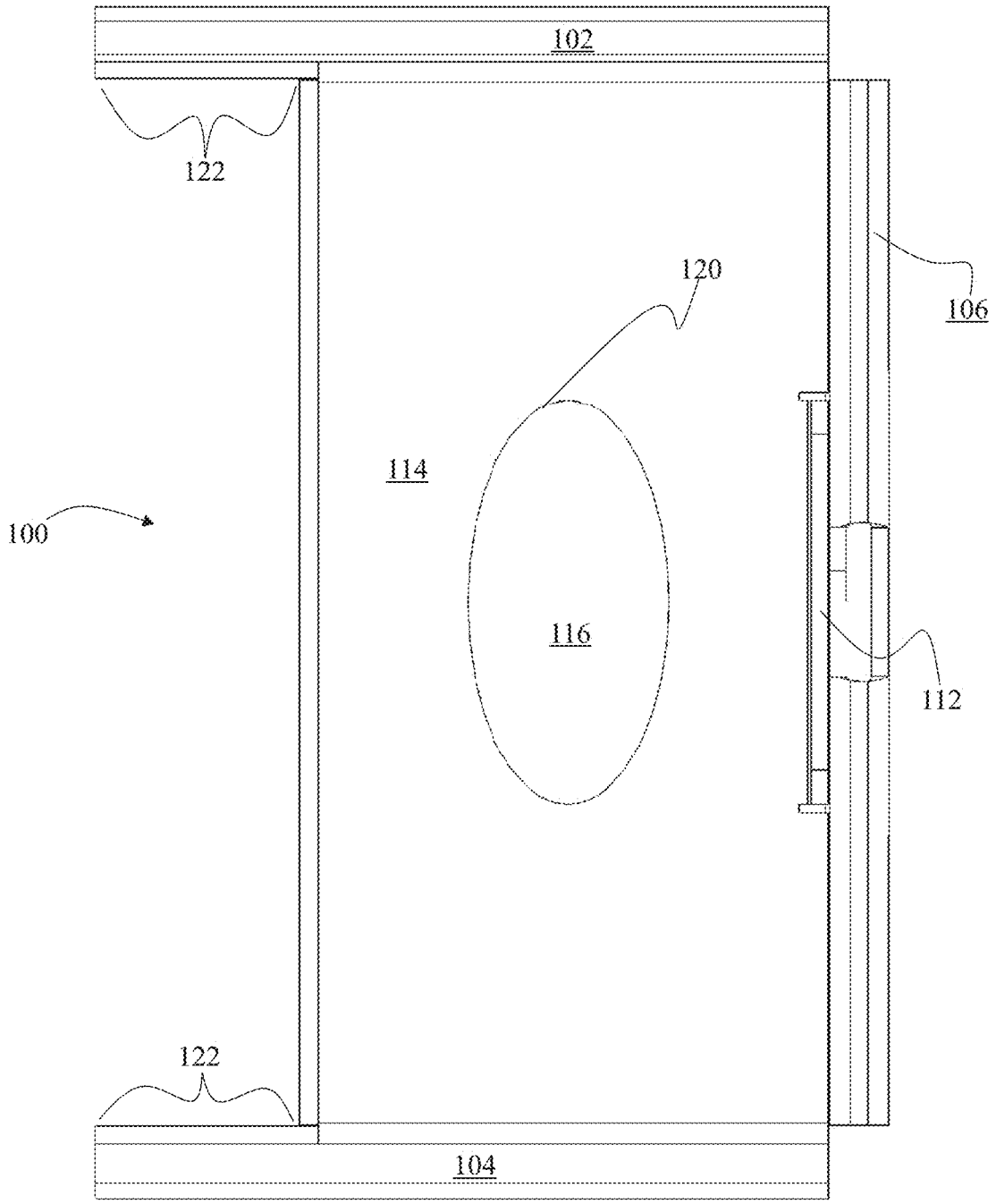
FIG. 10 is a top view of one non-limiting embodiment of a folded suspension shipping system.

FIG. 10 shows a top view of the suspension shipping system 100 of FIG. 1, according to one embodiment of the present disclosure. Illustrated in FIG. 10 is the extension of the first lateral suspension element 102 and the second lateral suspension element 104 beyond the product retention compartment 118 to form an air cushion gap 122.

Figure 11:
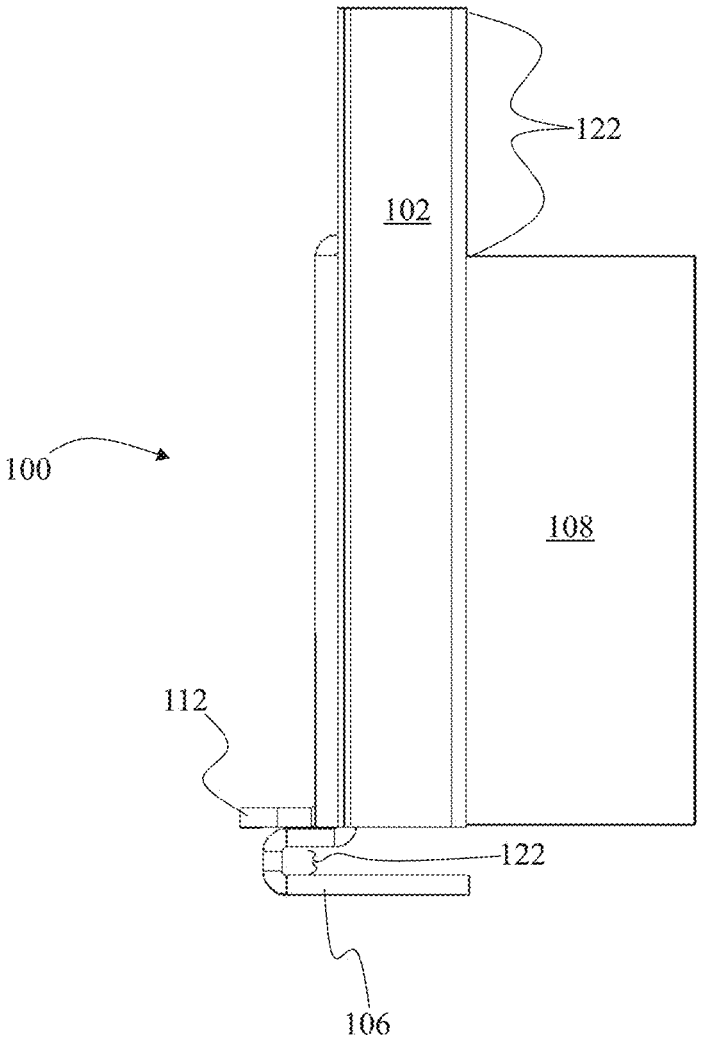
FIG. 11 is a left-side view of one non-limiting embodiment of a folded suspension shipping system.

FIG. 11 shows a left-side view of the suspension shipping system 100 of FIG. 1, according to one embodiment of the present disclosure. Well-illustrated in FIG. 11 are the use of extending the first lateral suspension element 102 beyond the product retention compartment 118 to form an air cushion gap 122 via the structure of the packing material.

Figure 12:
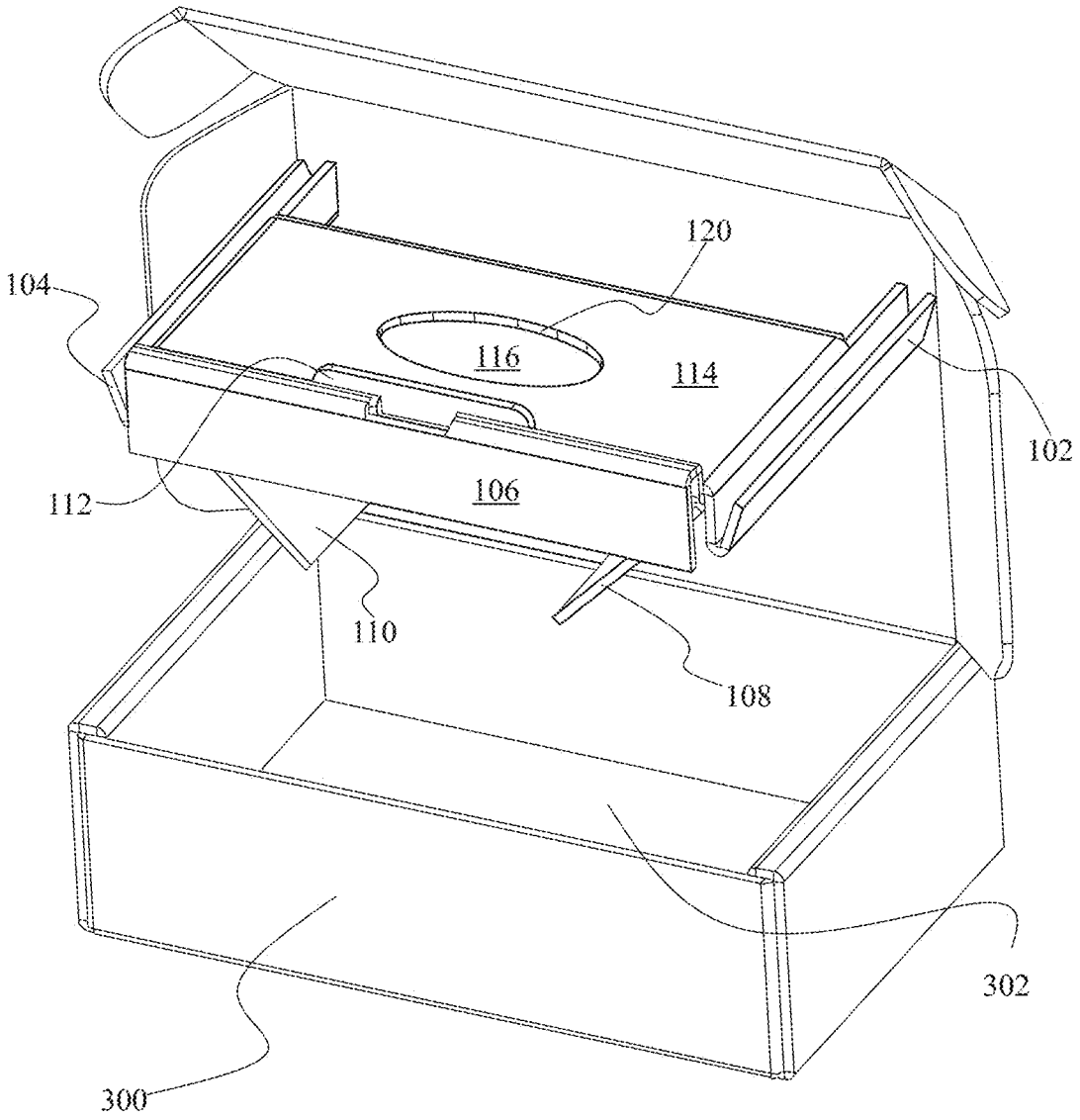
FIG. 12 is a perspective view of one non-limiting embodiment view of one non-limiting embodiment of a folded suspension shipping system wherein the folded suspension shipping system is shown in association with an environmental setting; and, FIG. 13 is an additional perspective view of one non-limiting embodiment view of one non-limiting embodiment of a folded suspension shipping system wherein the folded suspension shipping system is shown inserted into an one possible environmental setting.

FIG. 12 illustrates the suspension shipping system 100 being placed into an outer container 300 as described herein. Said outer container 300 may be a wide variety of sizes due to the formation of the air cushion gap 122 in a 360-degree perspective around the product retention compartment 118, due to inherent flexibility of the first lateral suspension element 102, the second lateral suspension element 104, the front suspension element 106, the first lower cushion support element 108 and the second lower cushion support element 110. Further, as the suspension shipping system 100 is lowered into an outer container 300, as can be viewed, the first lower cushion support element 108 and the second lower cushion support element 110 may exert a compressive force when lowered into the outer container 300, by way of example only in FIG. 13.

Figure 13:
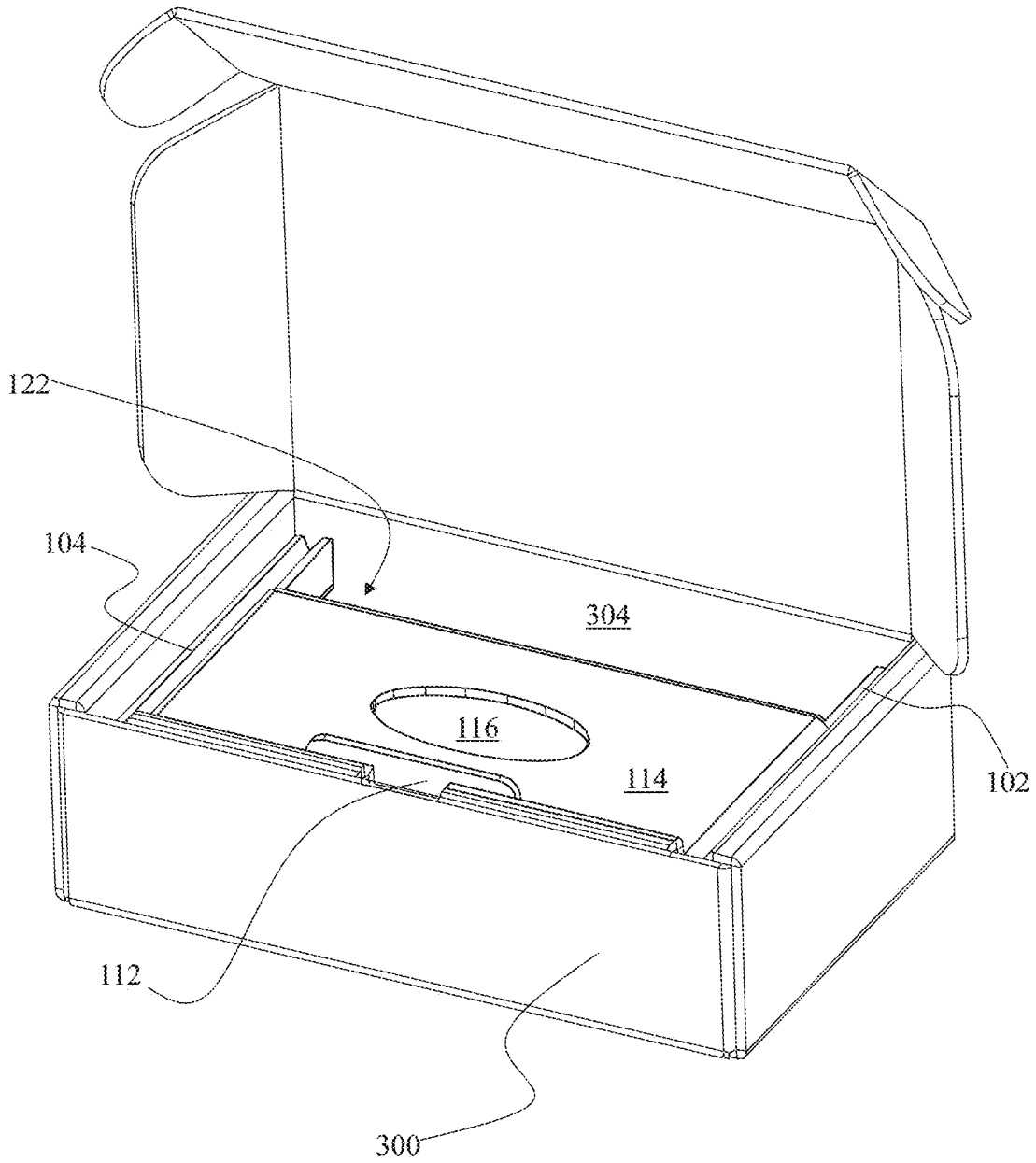

FIG. 13 shows the suspension shipping system 100 fully inserted into the outer container 300 for shipping purposes. As seen, front suspension element 106 may span the internal height of the outer container 300, and the first lateral suspension element 102 and the second lateral suspension element 104 may extent to the rear of the outer container 300, while the first lower cushion support element 108 and the second lower cushion support element 110 may exert a lower force against the bottom of the outer container 300 (by way of example only, as seen in FIG. 12).

Having disclosed the structure of the preferred embodiments, it is now possible to describe its function, operation, and use.

The suspension shipping system 100 may be continuously connected as seen in FIG. 2. The outer container 300 may have an interior portion 302 (for example only, as seen in FIG. 12). The suspension shipping system 100 may be folded upon itself. When the suspension shipping system 100 is placed into an interior portion 302 of an outer container 300, the first lower cushion support element 108 and the second lower cushion support element 110 may force the product retention compartment 118 closed. When closed, this may be referred to as a or the closed configuration. The securing tab 112 may also maintain the suspension shipping system 100 in the closed configuration.

Some embodiments of the suspension shipping system 100 may be described as comprising a product retention compartment 118 from which may extend a first lateral suspension element 102, a second lateral suspension element 104, a front suspension element 106, a first lower cushion support element 108, and a second lower cushion support element 110. The extension of the first lateral suspension element 102, the second lateral suspension element 104, the front suspension element 106, the first lower cushion support element 108 and the second lower cushion support element 110 may form an air cushion gap 122 completely enveloping the product retention compartment 118.

Further embodiments may include the first lateral suspension element 102 and the second lateral suspension element 104 which may be elongated with respect to the product retention compartment 118 such that the product retention compartment 118 cannot physically contact a back end 304 of an interior portion 302 of an outer container 300.

Further embodiments may include a securing tab 112 which may be used to secure the product retention compartment 118 in a closed configuration.

Further embodiments may include the first lower cushion support element 108 and the second lower cushion support element 110 which may further force the product retention compartment 118 into the closed configuration when the suspension shipping system 100 is placed into an interior portion 302 of an outer container 300.

Further embodiments may include the product retention compartment 118 which may further have a first product retention member 114 and a second product retention member 116, the first product retention member 114 may have a product viewing portal 120.

Further embodiments may include may be described as a foldable suspension shipping system 100 which may comprise a product retention compartment 118 which may have a first lateral suspension element 102 and a second lateral suspension element 104 which may extend from the product retention compartment 118 laterally. The product retention compartment 118 which may have a front suspension element 106 therein and may extend from the product retention compartment 118 frontally. The product retention compartment 118 may further have a first lower cushion support element 108 and a second lower cushion support element 110 which may extend from the product retention compartment 118 lowerly. ("Lowerly" as used herein may be interpreted as below). The product retention compartment 118 may be configured for placement in an interior portion 302 of an outer container 300. The product retention compartment 118 may further have an air cushion gap 122 which may extend three hundred and sixty degrees around the product retention compartment 118 when the product retention compartment 118 is placed into an outer container 300.

Further embodiments may include the product retention compartment 118 which may have a first product retention member 114 and an second product retention member 116, the first product retention member 114 may further have a product viewing portal 120.

Further embodiments may include the first lateral suspension element 102 and the second lateral suspension element 104 may additionally extend beyond the product retention compartment 118 backly, ("backly" as used herein may be interpreted as to the back) such that the product retention compartment 118 may not physically contact the back end 304 of the outer container 300.

Further embodiments may include a securing tab 112 which may be used to secure the product retention compartment 118 in a closed configuration.

Further embodiments may include the first lower cushion support element 108 and the second lower cushion support element 110 which may force the product retention compartment 118 into the closed configuration when the continuously connected suspension shipping system 100 is placed into an interior portion 302 of an outer container 300.

Further embodiments may include a first product retention member 114 and a second product retention member 116, being folded along a first fold line 201 to form a product retention compartment 118. A first lateral suspension element 102 may be folded along a seventh fold line 207 and an eighth fold line 208. A second lateral suspension element 104 may be folded along a fifth fold line 205 and a sixth fold line 206. A front suspension element 106 may be folded along a second fold line 202, a third fold line 203 and a fourth fold line 204. A first lower cushion support element 108 may be folded along a second lower fold line 212 and a second lower cushion support element 110 may be folded along a first lower fold line 210.

Further embodiments may include the first lateral suspension element 102 and the second lateral suspension element 104 which may extend beyond the product retention compartment 118 such that the product retention compartment 118 cannot physically contact the outer container 300.

Further embodiments may include the front suspension element 106 which may extend beyond the product retention compartment 118 such that the product retention compartment 118 cannot physically contact the outer container 300.

Further embodiments may include the first lower cushion support element 108 and the second lower cushion support element 110 which may completely prevent the product retention compartment 118 from physically contacting the outer container 300.

Further embodiments may include a securing tab 112 which may be folded at securing tab fold line 214 and used to secure the product retention compartment 118 in a closed configuration.

Further embodiments may include the first lower cushion support element 108 and the second lower cushion support element 110 which may further force the product retention compartment 118 into a closed configuration when the continuously connected suspension shipping system 100 is placed into an interior portion 302 of an outer container 300.

Further embodiments may include the first product retention member 114 which may have a product viewing portal 120.

While embodiments of the present disclosure have been illustrated and described, it is not intended that these embodiments illustrate and describe all possible forms of this disclosure. Rather, the words used in the specification are words of description rather than limitation, and it is understood that various changes may be made without departing from the spirit and scope of the disclosure.

Accordingly, it is not intended that the various embodiments be limited except by the appended claims. Insofar as the description above and the accompanying drawings disclose any additional subject matter that is not within the scope of the claims below, the embodiments are not dedicated to the public and the right to file one or more applications to claim such additional embodiments is reserved.

What is claimed is:

1. A suspension shipping system comprising:

a product retention compartment formed by folding a first product retention member over a second product retention member, and from which extends a first lateral suspension element, a second lateral suspension element, a front suspension element, a first lower cushion support element, and a second lower cushion support element;

the extension of the first lateral suspension element, the second lateral suspension element, the front suspension element, the first lower cushion support element and the second lower cushion support element forming an air cushion gap, the air cushion gap completely enveloping the product retention compartment.

2. The suspension shipping system of claim 1, wherein the first lateral suspension element and the second lateral suspension element are elongated with respect to the product retention compartment such that the product retention compartment cannot physically contact a back end of an interior portion of an outer container.

3. The suspension shipping system of claim 1, wherein a securing tab is used to secure the product retention compartment in a closed configuration.

4. The suspension shipping system of claim 1, wherein the first lower cushion support element and the second lower cushion support element further force the product retention compartment into the closed configuration when the suspension shipping system is placed into an interior portion of an outer container.

5. The suspension shipping system of claim 1, wherein the first product retention member has a product viewing portal.

6. A foldable suspension shipping system comprising, a product retention compartment having a first lateral suspension element and a second lateral suspension element therein extending from the product retention compartment laterally; the product retention compartment further having a front suspension element therein extending from the product retention compartment frontally;

the product retention compartment further having a first lower cushion support element and a second lower cushion support element therein extending from the product retention compartment lowerly;

the product retention compartment being configured for placement in an interior portion of an outer container; and the product retention compartment having an air cushion gap which extends three hundred and sixty degrees around the product retention compartment when the product retention compartment is placed into an outer container.

7. The foldable suspension shipping system of claim 6, wherein the product retention compartment further has a first product retention member and a second product retention member, the first product retention member further having a product viewing portal.

8. The foldable suspension shipping system of claim 6, wherein the first lateral suspension element and the second lateral suspension element additionally extend beyond the product retention compartment backly, such that the product retention compartment cannot physically contact the back end of the outer container.

9. The foldable suspension shipping system of claim 6, wherein a securing tab is used to secure the product retention compartment in a closed configuration.

10. The foldable suspension shipping system of claim 6, wherein the first lower cushion support element and the second lower cushion support element force the product retention compartment into the closed configuration when the continuously connected suspension shipping system is placed into an interior portion of an outer container.

11. A continuously connected suspension shipping system for placement inside of an outer container, comprising:

a first product retention member and a second product retention member, being folded along a first fold line to form a product retention compartment;

a first lateral suspension element being folded along a seventh fold line and an eighth fold line, a second lateral suspension element being folded along a fifth fold line and a sixth fold line, and a front suspension element being folded along a second fold line a third fold line and a fourth fold line; and a first lower cushion support element being folded along a second lower fold line and a second lower cushion support element being folded along a first lower fold line.

12. The continuously connected suspension shipping system for placement inside of an outer container of claim 11, wherein the first lateral suspension element and the second lateral suspension element extend beyond the product retention compartment such that the product retention compartment cannot physically contact the outer container.

13. The continuously connected suspension shipping system for placement inside of an outer container claim 11, wherein the front suspension element extends beyond the product retention compartment such that the product retention compartment cannot physically contact the outer container.

14. The continuously connected suspension shipping system for placement inside of an outer container claim 11, wherein the first lower cushion support element and the second lower cushion support element completely prevent the product retention compartment from physically contacting the outer container.

15. The continuously connected suspension shipping system for placement inside of an outer container of claim 11, wherein a securing tab is folded at securing tab fold line and used to secure the product retention compartment in a closed configuration.

16. The continuously connected suspension shipping system for placement inside of an outer container of claim 11, wherein the first lower cushion support element and the second lower cushion support element further force the product retention compartment into a closed configuration when the continuously connected suspension shipping system is placed into an interior portion of an outer container.

17. The continuously connected suspension shipping system for placement inside of an outer container of claim 11, wherein the first product retention member has a product viewing portal.

* * * * *